United States Patent [19]

Wells et al.

[11] 4,003,493

[45] Jan. 18, 1977

[54] EASY-OPEN CONTAINER WITH NONDETACHABLE OPENING MEMBER

[76] Inventors: Robert A. Wells, 4450 Harris Trail NW.; Carl J. Strobe, 2831 Orchard Knob, both of Atlanta, Ga. 30327

[22] Filed: Dec. 9, 1975

[21] Appl. No.: 639,167

Related U.S. Application Data

[63] Continuation-in-part of Ser. No. 580,624, May 27, 1975.

[52] U.S. Cl. ..... 220/267; 220/268; 220/277

[51] Int. Cl.[2] ..... B65D 41/32

[58] Field of Search ..... 220/266, 267, 268, 269, 220/277; 222/541, 83

[56] References Cited

UNITED STATES PATENTS 3,236,409 2/1966 Cross et al. ..... 220/260

3,934,750 1/1976 Herbst ..... 220/268 X

*Primary Examiner*—George T. Hall

[57] ABSTRACT

An easy-open container having a wall in which an openable member is defined by a selectably separable region. A separate opening tab member is secured to the openable member to receive manual opening force and fracture the separable region. A flange on the opening tab member overlies at least part of the separable region to prevent the opening tab member and the attached openable member from freely entering the container. The openable member is nondetachably retained on the container by the configuration of the separated openable member, or by a pivotable connection between the opening tab member and the container.

24 Claims, 19 Drawing Figures

EASY-OPEN CONTAINER WITH NONDETACHABLE OPENING MEMBER

This is a continuation-in-part of pending application Ser. No. 580,624 filed May 27, 1975.

This invention relates in general to containers and in particular to easyopen containers of the type typically used for commodities such as beverages and the like.

The widespread popularity of easy-open containers, such as containers of the well-known "pop top" variety which are used with beverage containers and the like, has created problems relating to the proper disposal of the tear tab or other easy opening structure which becomes completely removed from the container upon opening. The removable tear tabs, being relatively small and frequently having rough torn metal edges, are often discarded simply by being dropped on the ground as soon as the beverage container is opened. Improper disposal of tear tabs provides a litter problem which is unsightly and may also be hazardous, since the sharp edges of the tear tabs are likely to be underfoot at beaches or other places frequented by people without footwear.

Numerous alternatives to the conventional pop top beverage container have been proposed which supposedly provide the ease and convenience of manual opening while remaining attached to the container at all times during and after the opening process. Such proposed easy-open containers have met with a number of practical objections, however, which have prevented any significant commercial or consumer acceptance. Many proposed nondetachable easy-open devices are too complex in design or construction to be manufactured without requiring a substantial increase in the cost of the container, and ultimately an increase in the price which the consumer must pay to purchase beverages in such containers. Other proposed nondetachable easy-open structures have been difficult to open manually, have presented a real or perceived hazard during opening, or have otherwise been unacceptable to those who package their product in such containers or who consume the product therefrom.

Accordingly, it is an object of the present invention to provide improved easy-open container apparatus.

It is another object of the present invention to provide improved easy-open container apparatus in which a separable opening member is retained on the opened container.

It is still another object of the present invention to provide relatively economical easy-open container apparatus having an openable member which remains attached to the container.

Stated in general terms, the foregoing and other objects of the present invention are provided by an easy-open container having a wall in which a selectably separable region of predetermined weakness is formed to define an openable member. The opening member cannot be withdrawn from the opening in the container wall, and an opening tab member secured to the outer surface of the openable member prevents the opening member from freely entering the container opening. The opening tab member includes means which overlies at least a portion of the selectably separable region to limit the extent of inward movement of the opening tab member and the attached openable member when the separable region becomes separated. Stated more particularly, the opening tab member receives manual opening force directed toward the container wall and applies the opening force to the separable region to fracture the separable region and initiate opening of the container. Once the full extent of the separable region is separated, the opening tab member is manually moved along the outer surface of the container wall to displace the openable member within the container and away from the container wall, thus providing an opening in the wall through which the contents of the container may be poured or otherwise consumed.

The foregoing and other aspects of the present invention will become more readily apparent from the following description of several disclosed embodiments thereof, including the drawings in which.

Figure 1:
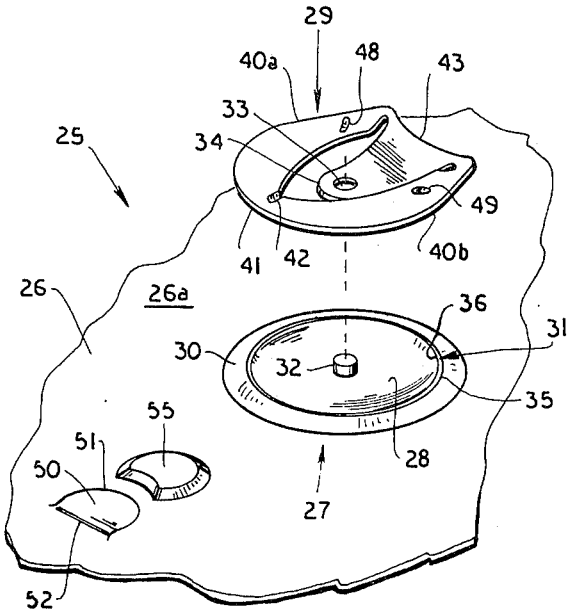
FIG. 1 shows a fragmentary exploded pictorial view of a container end wall including easy-open structure according to a disclosed embodiment of the present invention.

Turning to the embodiment shown in FIGS. 1–6, easy-opening container structure shown generally at 25 includes a fragmentary portion 26 of a container wall which may be one of the ends used with a conventional beverage container or the like. An openable member 27 is defined in the wall 26 by the selectably separable region 31, and an opening tab member 29 is secured to the openable member by any appropriate securement such as the rivet 32 which extends through the opening 33 in the member 34 of the opening tab member. The separable region 31 provides a region of predetermined structural weakness which is formed in the wall 26. Assuming that the wall 26 is made of thin metal such as aluminum, steel, or the like, the separable region 31 can be provided by a score line which is coined or otherwise formed in the wall in a manner known to those skilled in the art. The score line may extend only partially through the thickness of the wall 26, or may alternatively be a repaired score in which the openable member 27 is initially severed from the wall 26 and then reattached to the wall by applying a suitable sealing material along the line of separation on the inside surface **26*b* of the wall. Various types of coining, scoring, and other metal working techniques used in easy-open container construction are known to those skilled in the art and need not be repeated herein. The selectably separable regions associated with the easy-opening structure of the present invention, including the separable region 31** and like regions of other disclosed embodiments of the present invention, are hereinafter identified as a "separable region" irrespective of the design of the separable region or the manufacturing technique used to form the region.

The outer surface 28 of the openable member 27 is concave relative to the outer surface **26*a* of the wall 26, and is defined by the separable region 31 to have a generally circular configuration, although the particular overall configuration of the openable member is not considered to be a critical aspect of the present invention. The concave openable member 27 is surrounded by a generally convex annular rim 30 which is raised slightly above the nominal outer surface 26*a* of the wall 26, as best shown in FIG. 3, and the separable region 31 is located at the inner periphery of the annular rim. It is apparent from FIG. 3 that the separable region 31, in the embodiment of FIGS. 1–6, includes an annular score line 35 formed in the outer surface of the annular rim 30 by coining or the like, and an annular V-shaped score line 36 which is within the score line 35. The inner score line 36 provides a fracturable web 37 of metal between the root of the score line 36 and the inner surface 26*b* of the web 26. Those skilled in the art will recognize that the type of separable region 31 shown in FIG. 3 is known as the "Alcoa B-48" score, as more particularly described in U.S. Pat. No. 3,902,626, and the purpose of the particular depicted scoring becomes apparent below. It should be understood, however, that the use of the particular type of separable region depicted in FIG. 3** is but one example of separable region which can be used in the practice of the present invention.

Figure 2:
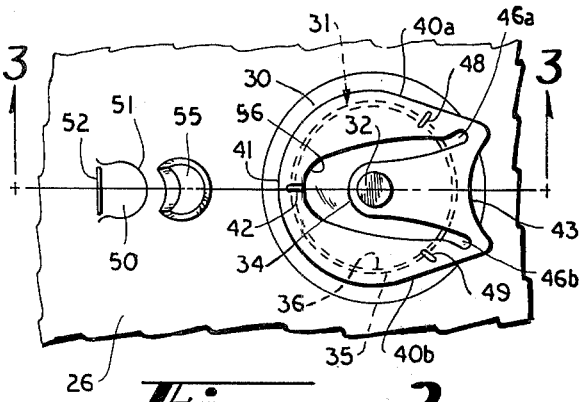
FIG. 2 shows a top plan view of the assembled embodiment shown in FIG. 1.
Figure 3:
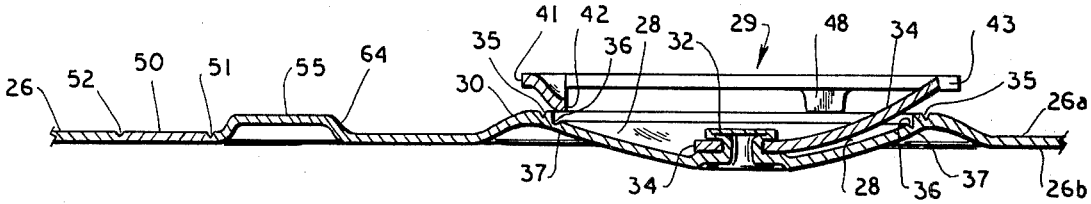
FIG. 3 is a vertical section view taken along line 3—3 of FIG. 2.

The opening tab member 29 has flange portions **40*a* and 40*b* which overlie confronting portions of the separable region 31, as best shown in FIG. 2, and the two flange portions join each other at a forward end 41 which likewise overlies the separable region. It is apparent from FIG. 3 that the overlying flange portions of the opening tab member 29, including the portion 41, are spaced outwardly a distance from the outer surface of the rim 30 which lies beneath the overhanging flange portions. Projecting downwardly from the end flange portion 41 and from each of the flange portions 40*a* and 40*b* are bosses 48, 49, and 42, respectively, which are disposed to lie immediately above the annular rim 30 or above the openable member 27 within the separable region 31. The bosses 41, 48, and 49 may be in actual contact with the annular rim 30 or the openable member 27, as the case may be, or may alternatively be spaced a distance outwardly and apart therefrom. Although three discrete bosses are depicted in the embodiment of FIGS. 1–6, it should be understood that a greater or lesser number of bosses or downward projections may be used. Moreover, the discrete bosses may alternatively be replaced by a continuous structural means which is on the undersides of the flange portions 40*a*, 40*b*, and 41, and which is contiguous to most or all of the annular extent of the annular rim 30**.

The member 34 of the opening tab member 29 is a generally elongate finger member which extends from the rivet opening 33, disposed within the concave outer surface 28, toward the remote end 43 which may be beyond the openable member 27 defined by the separable region 31. The remote end 43 is joined to the flange portions **40*a* and 40*b*, and the finger member 34 is separated from the flange portions to define the slots 46*a* and 46*b*. It is apparent that the entire opening tab member 29 is preferably a unitary member which may be stamped from metal, or which may alternatively be molded or otherwise formed from a suitable material such as various plastic substances or the like. The finger member 34 extends generally downwardly from the remote end 43 to the rivet-receiving opening 33, as best shown in FIG. 3, so that the contour of the finger member 34 approximates the concave contour of the outer surface 28. Although the finger member 34 is shown as being secured to the openable member 27 by the rivet 32, it should be understood that other means of securement such as welding, bonding, or the like may be used in place of a rivet inasmuch as the connection between the openable member 27 and the opening tab member 29** is not subjected to pulling or bending stresses during the opening of the container as described below.

A vent member 50 provided in the wall 26 in spaced apart relation from the end flange portion 41 of the opening tab member 29. The vent member 50 is defined by the selectably separable score line 50 and by the nonseparable bend line 52. Interposed between the vent member 50 and the openable member 27 is the locking member 55, which projects outwardly from the outer surface **26*a* of the wall 26 and which may be formed in the wall by a stamping process or the like. The peripheral configuration of the locking member 55 is preferably complementary to the contour 56 of the open region between the finger member 32 and the flange portion 41 of the opening tab member 29**.

The embodiment described with respect to FIGS. 1–6 is opened in the following manner. Opening is initiated by manually pressing downwardly on the opening tab member 29 with a thumb or forefinger, for example. The force directed against the opening tab member 29 is applied to the separable region 31 by means of the bosses 42, 48, and 49 (or by other structure located on the underside of the opening tab member flange portions, as previously mentioned), causing deflection of the annular rim 30 and consequent fracture of the fracturable web 37.

The openable member 27 is now separated from the wall 26, and the openable member moves inwardly of the wall until the flange portions **40*a*, 40*b*, and 41 engage the outer surface 26***a* of the wall. The openable member 27 and the attached opening tab member 29 now occupy the position shown in FIG. 4, and it is apparent that the flange portions of the opening tab member prevent the opening tab member and attached openable member 27 from freely entering the container partially defined by the wall 26. It can also be seen that the flange portions of the openable tab member prevent a person's thumb or finger from possible injurious contact with the edge 62 of the opening 61 formed in the wall 26 by fracture of the fracturable web 37.

Figure 5:
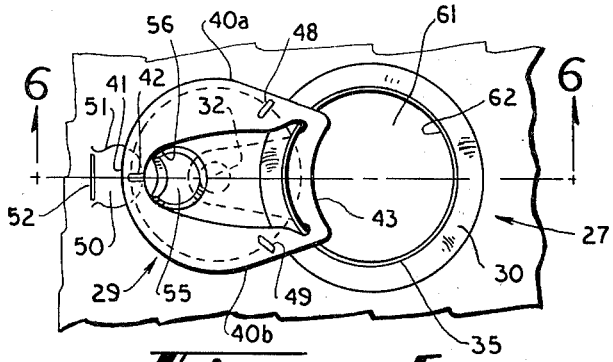
FIG. 5 is a top plan view of the assembled apparatus in FIG. 1, after the separated openable member and attached opening tab member have been completely displaced to expose the opening in the wall.
Figure 4:
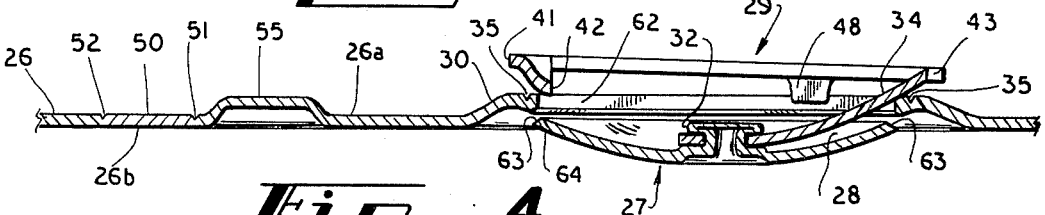
FIG. 4 is a vertical section view taken along line 3—3, immediately after the openable member has become separated from the end wall by fracture of a selectably separable region.
Figure 6:
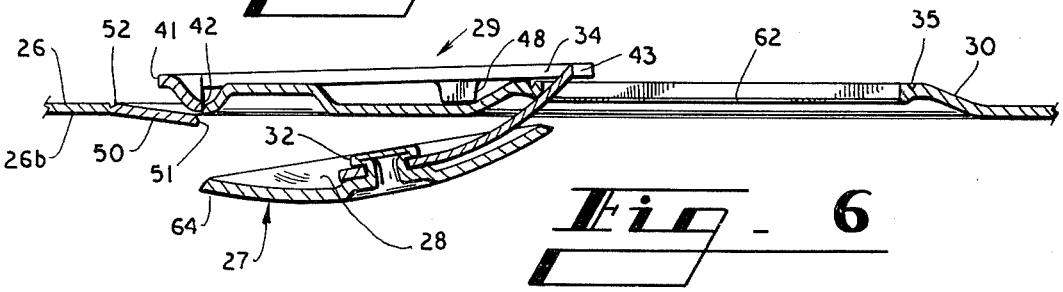
FIG. 6 shows a vertical section view taken along line 6—6 of FIG. 5.
Figure 7:
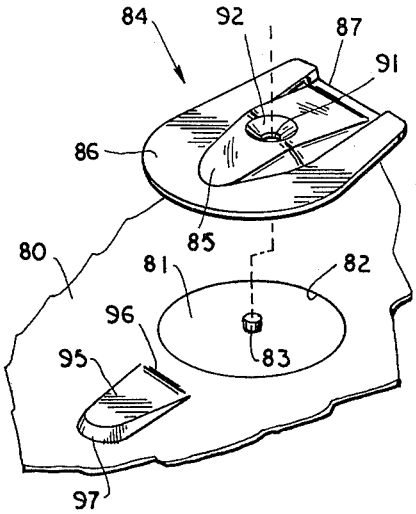
FIG. 7 is a fragmentary exploded pictorial view of a container end wall according to another disclosed embodiment of the present invention.

Following separation of the openable member 27 from the wall 26, the openable member is now displaced away from the opening 61 by sliding the opening tab member toward the locking member 55 (to the left as viewed in FIGS. 4–6). Since the leading edge 64 of the separated openable member is below the adjacent portion of the opening edge 62, as seen in FIG. 4, the openable member 27 is slidably displaced beneath the inner surface 26*b* of the wall 26 while the opening tab member is slidably displaced along the outer side 26*a* of the wall. Continued sliding of the opening tab member 29 causes the end flange portion 41 to ride over the inclined surface 64 of the locking member 55, so that the boss 42 of the end flange portion 41 becomes disposed above the vent member 50. The opening tab member 29 is now in the fully-open position as shown in FIG. 5, where the openable member 27 has been substantially completely removed from the opening 61 in the wall 26. Further sliding forward movement of the opening tab member 26 is prevented by engagement of the slots 46*a* and 46*b* with confronting portions of the edge 62.

The opening sequence is now completed by pressing downwardly on the end flange portion 41 of the opening tab member, as seen in FIG. 6, to fracture the score line 51 and displace the vent member 50 inwardly about the bend line 52. The boss 42, or some other suitable structural member of the end flange portion 41, moves downwardly into the opening provided by inward movement of the vent member 50, so that the boss engages the vent opening and retains the opening tab member from sliding movement in a direction back toward the opening 61 in the wall 26. The contents of the container may now be poured or consumed through the opening 61, and the open vent member 50 permits air to enter the container to replace the volume of contents withdrawn through the opening 61.

Referring to FIG. 4, it is seen that the outer edge 63 of the openable member 27 underlies surrounding portions of the edge 62. This underlying arrangement of the outer edge 63, which is provided in the embodiment of FIGS. 1–6 by the "B-48" score, prevents the openable member 27 from being withdrawn through the opening 61, so that the openable member and the attached opening tab member 29 remain attached to the wall 27 at all times and cannot be detached for improper disposal.

An alternative embodiment of the present invention is shown in FIGS. 7–10, in which a container wall 80 includes an openable member 81 defined by a separable region 82 formed in the wall. Although the separable region 82 may be fabricated in the same manner as the separable region 31 of the preceding embodiment, the separable region 82 is here shown as a so-called "repaired end" in which the openable member 81 is initially completely separated from the wall 80 along the cut line 88 during manufacture, followed by the application of a suitable sealing material 94 along the inner side of the cut line 88 to "repair" or reseal the openable member 81. The cut line 88 is preferably formed so that the outer edge 89 of the openable member 81 underlies the edge 90*a* of the opening 90 provided in the wall 80 by removal of the openable member as described below.

Attached to the openable member 81 is the opening tab member 84. The opening tab member 84 has an interior finger member 85 surrounded on two sides and an end by the flange portion 86 which overlies a substantial extent of the separable region 82. The finger member 85 has a forward end 93, best seen in FIGS. 8–10, which lies on the openable member 81 adjacent a point on the separable region 82 and which extends upwardly to a point 85*a* which may be slightly above the outer surface of the flange portion 86. The finger member 85 extends rearwardly and downwardly from the point 85*a* to the rear portion 87 which is integrally formed with corresponding rear portions of the flange portion 86. A conical recess 92 is formed in the finger member 85, and an opening 91 at the bottom of the recess 92 receives the rivet 83 formed in the outer surface of the openable member 81. It will be understood that the finger member 85 can be secured to the openable member 81 by means other than riveting, as discussed with respect to the preceding embodiment of the invention.

Formed in the wall 80 a distance spaced apart from the forward end 86a of the flange portion 86 is a locking member provided by the ramp surface 95 which slopes upwardly from the wall 80 at 96, and which terminates at a relatively abrupt jog 97 downwardly to the nominal outer surface of the wall 80.

Figure 8:
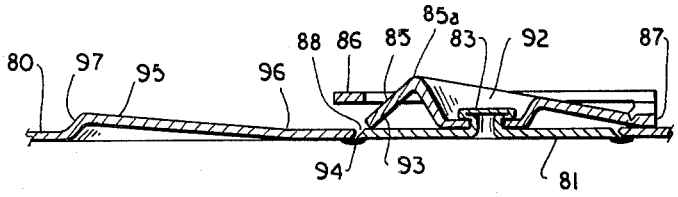
FIG. 8 is a vertical section view showing the embodiment of FIG. 7 in assembled form.
Figure 9:
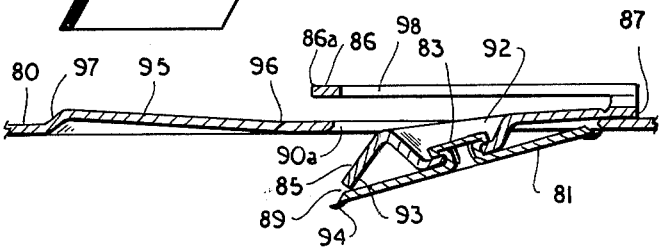
FIG. 9 is a vertical section view as in FIG. 8, showing the openable member immediately after separation of a selectably separable region.

Considering the operation of the embodiment disclosed in FIGS. 7–10, it is seen from FIG. 8 that the flange portion 86 is spaced outwardly from the separable region 82 and that the point 85*a* of the finger member 85 extends outwardly a distance beyond the flange portion 86. An opening force applied downwardly to the opening tab member 84 is received by the finger member 85 and applied through the forward end 93, as well as through other portions of the finger member, to cause fracture of the separable region 82. FIG. 9 shows the position of the openable member 81 immediately after fracture of the separable region, with the openable member moved downwardly below the wall 80 and with the flange portion 86 poised to move downwardly toward abutment of portions of the wall opening edge 90*a* which the flange portion 86 overlies. The flange portion 86 of the opening tab member thus prevents the openable member from free entry into the container partially formed by the wall 80, while the aforementioned underlying outer edge 89 of the openable member prevents the openable member from being withdrawn through the opening 90.

Figure 10:
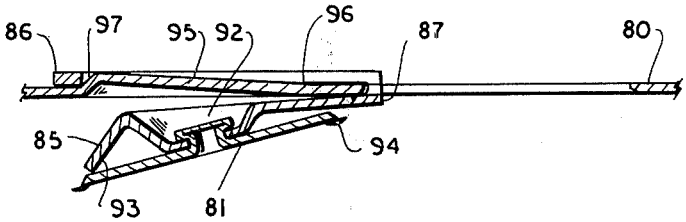
FIG. 10 is a vertical section view showing the assembled embodiment of FIG. 7 after the openable member and attached opening tab member have become completely displaced from the opening in the wall.

Opening of the embodiment shown in FIGS. 7–10 is completed by sliding the opening tab member 84 toward the ramp surface 95, so that the flange portion 86 slides along the outer surface of the wall 80 while the finger member 85 and the attached openable member 81 slide beneath the wall 80 as shown in FIG. 10. The slanted configuration of the forward end 93 assists the finger member 85 in slidable movement below the edge 90*a* of the opening 90 in the wall 80. The ramp surface 95, or at least the jog 97 thereof, is preferably configured to be received within the open space 98 which remains within the flange portion 86 when the finger member 85 slides below the wall 80, so that the jog 97 and the ramp 95 are received within the opening 98 to retain the opening tab member 84 in fully-open position as shown in FIG. 10.

The embodiment shown in FIGS. 11–15 differs from the two preceding embodiments in that the openable member 105 is nondetachably formed in the wall 104 of the container 103 by a discontinuous separable region 106 which is interrupted by the nonseparable bend line 107. While the bend line may be defined by a score formed in the outer surface of the wall 104 in accordance with known techniques, the bend line remains unbroken upon fracture of the separable region 106, and thus keeps the openable member 105 attached to the wall 104.

The opening tab member 109 is secured to the openable member 105 by suitable means such as the rivet 108 formed in the openable member and extending through the opening 116 in the forward end 115 of the elongated finger member 111. The finger member 111 is surrounded on substantially three sides by the flange portion 110 which extends above and overlies the separable region 106, as best seen in FIG. 12.

Figure 11:
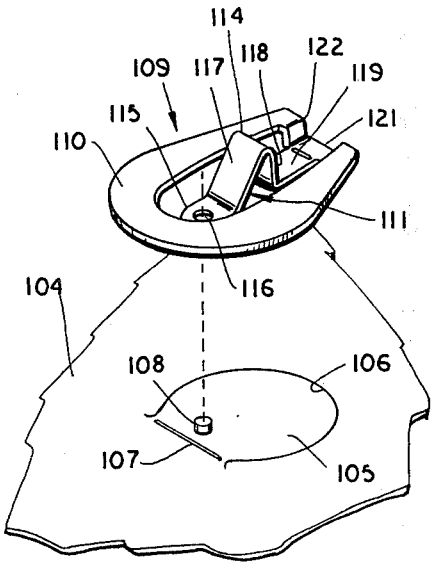
FIG. 11 is a fragmentary exploded pictorial view of another disclosed embodiment of the present invention.
Figure 12:
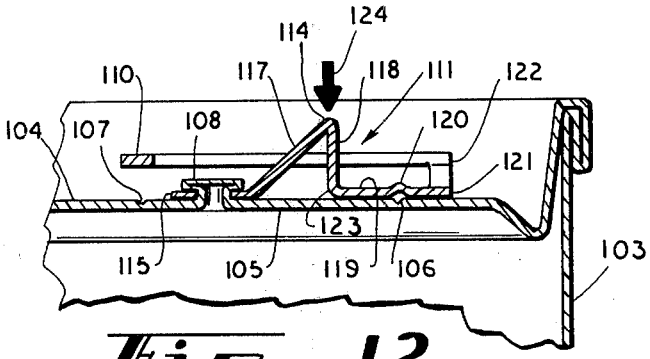
FIG. 12 is a vertical section view of the assembled embodiment shown in FIG. 11.

The finger member 111, as best seen in FIGS. 11 and 12, has the aforementioned forward end 115 and a first intermediate portion 117 which extends rearwardly of the forward end 115 and outwardly from the openable member 105 to terminate at a bend region 114 which extends outwardly beyond the flange portion 110. A second intermediate portion 118 extends downwardly from the bend region 114 to a second bend region 123 to join the third intermediate portion 119, which lies along the outer surface of the openable member 105. The third intermediate portion 119 joins the rear portion 121 of the finger member 111 through the bend line 120, best seen in FIG. 12, which may be structurally defined in the third intermediate portion. The rear portion 121 of the finger member 111 is joined to the rear portion 122 of the flange portion 110, and it will be understood that the entire opening tab member 109 can advantageously be formed from a unitary piece of metal or suitable plastic material by techniques known to those skilled in the art.

Figure 13:
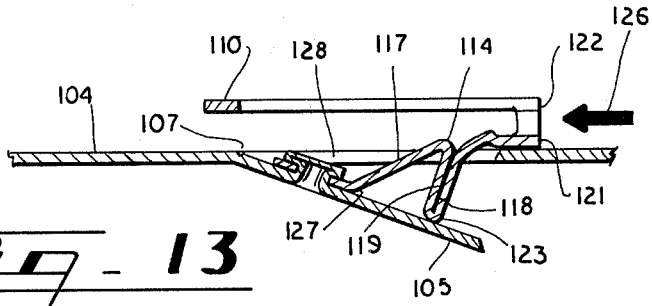
FIG. 13 is a vertical section view as in FIG. 12, immediately after the dicontinuous separable region has been separated by downward force applied to the opening tab member.
Figure 14:
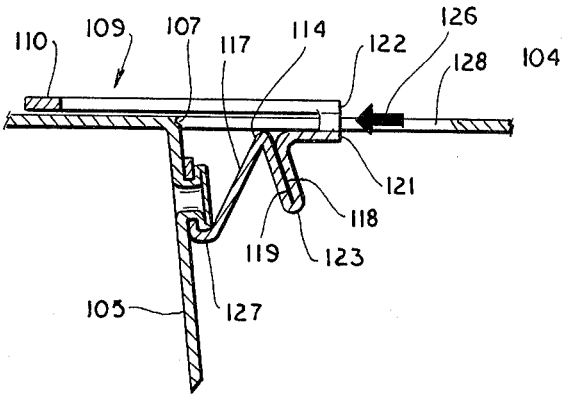
FIG. 14 is a vertical section view showing the openable member at a partially opened position.

The embodiment shown in FIGS. 11–15 is opened in the following manner. Thumb or finger force, indicated by the arrow 124, is directed downwardly on the opening tab member 109 and is applied through the bend region 114, the first intermediate portion 117, and the second intermediate portion 118 to the openable member 105. The resulting application of force to the openable member causes the separable region 106 to fracture, allowing the openable member 105 to pivot about the bend line 107 and move downwardly a distance below the wall 104, as shown in FIG. 13.

The opening tab member 109 and the openable member 105 are now completely displaced from the opening 128 in the wall 104 by applying force to the opening tab member in a direction substantially parallel to the wall 104 and toward the bend line 107, as indicated by the arrow 126. As best seen in FIG. 13, the second and third intermediate portions 118 and 119 abut each other at this time, and so a component of the sliding force is applied through the first intermediate portion 117 to the openable member 105 at a location displaced from the bend line 107, causing the openable member to undergo further pivoting movement about the bend line 107 and to assume the intermediate position shown in FIG. 14. The first intermediate portion 117 becomes bent about the region 127, relative to the forward end 115 of the finger member 111. The rear portion 121 of the finger member 111 has moved off the outer side of the wall 104 and into the opening 128, so that the flange portion 110 has moved downwardly into slidng contact with the wall 104.

Figure 15:
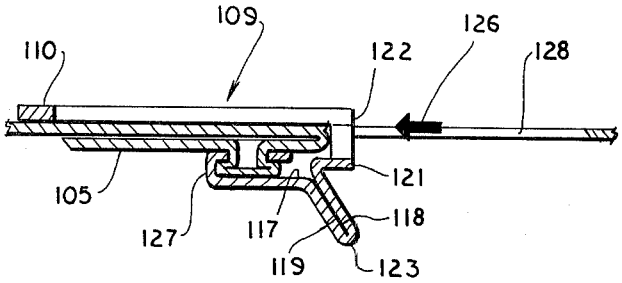
FIG. 15 is a vertical section view showing the openable member in fullyopened position.
Figure 16:
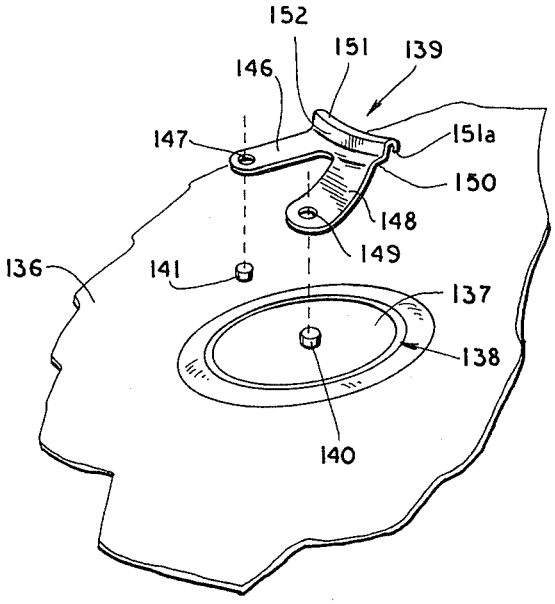
FIG. 16 is a fragmentary exploded pictorial view showing yet another disclosed embodiment of the present invention.

Continued application of sliding force in the direction of the arrow 126 causes the opening tab member 109 and the openable member 105 to assume the final position shown in FIG. 15, wherein the openable member 105 is completely displaced from the opening 128 in the wall and may assume a position substantially beneath the wall. It is apparent that only the rear portion 122 remains in the opening 128 at this time, so that the contents of the container can be freely poured through or consumed from that opening. The flange portion 110 of the opening tab member prevents possible injurious contact of a thumb or finger with the periphery of the opening 128, during application of opening force, and the nonseparable bend line 107 prevents the openable member 105 and the attached opening tab member 109 from becoming separated from the container wall 104.

Figure 17:
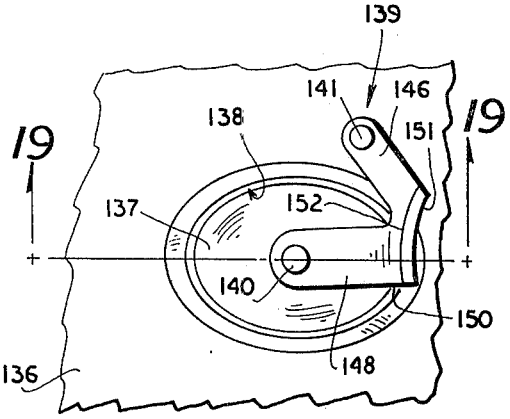
FIG. 17 is a top plan view of the assembled apparatus shown in FIG. 16.
Figure 18:
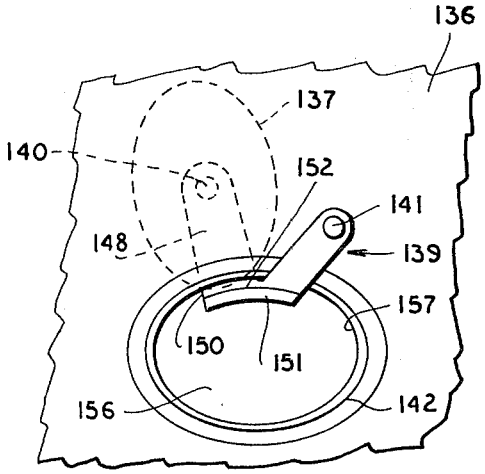
FIG. 18 is a top plan view as in FIG. 17, showing the easy-open apparatus in fully-opened position.

Turning next to the embodiment shown in FIGS. 16–19, the container wall 136 includes an openable member 137 which is defined by the separable region 138. The openable member 137 is noncircular and is seen in FIGS. 17 and 18 to be oval, although the noncircularity or the particular shape of the openable member is not considered to be a critical feature of the invention. The separable region 138, which is uninterrupted so that the openable member 137 can become completely detached from the wall 136, is similar to the separable region 31 discussed above with respect to the embodiment shown in FIGS. 1–6. The separable region 138, accordingly, includes the outer annular score line 142 which is formed on the top of an annular rim 144 raised outwardly from the wall 136, and the inner annular score line 143 which defines the fracturable web 145 surrounding and defining the openable member 137. It will be understood that the separable region 138 becomes fractured so that the outer edge of the separated openable member 137 underlies adjacent edge portions of the opening 156 which remains in the wall 136, thereby preventing withdrawal of the separated openable member 137 through the opening in the wall. It should be understood, however, that the particular configuraton of separable region 138 shown and described with respect to the embodiment of FIGS. 16–19 is by way of example only, and that other types of separable regions are useable with the present embodiment.

The openable member 137 is permanently attached to the wall 136 by the separate opening tab member 139, which allows the openable member (upon fracture of the separable region 138) to be pivoted about an axis which lies outside of the opening 156 in the wall 136. The opening tab member 139 has a first end portion 148 which is generally configured to lie along the concave outer surface of the openable member 137, a second end portion 146 which lies generally along the outer side of the wall 136 beyond the openable member 137, and an intermediate portion 150 which extends between the first and second end portions. An opening 147 is formed at the outermost end of the second end portion 146, and the second end portion is pivotably attached to the wall 136 by means such as the rivet 141 formed in the wall, so that the second end portion is pivotable with respect to the rivet 141 and the wall 136. The first end portion 148 of the opening tab member 139 is secured to the spindle openable member 137 by appropriate means such as the rivet 140 formed in the openable member. It will be seen that the securement between the first end portion 148 and the openable member 137 need not be pivotable, and so securement means other than the rivet 140 may be alternatively provided.

Figure 19:
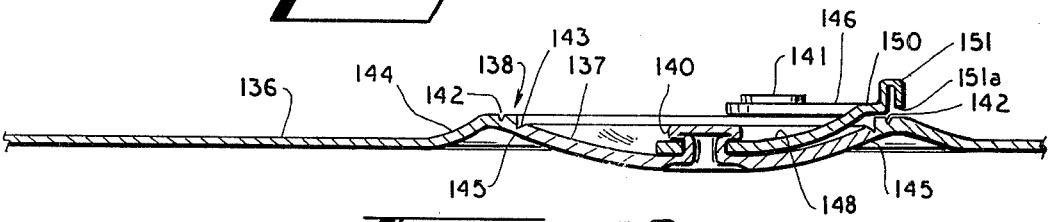
FIG. 19 is a vertical section view taken along line 19—19 of FIG. 17.

The intermediate portion 150 of the opening tab member 139 has a lip 151 which is positioned immediately above a portion of the separable region 138, as best seen in FIG. 19. The lip 151 may advantageously have the edge portion 151*a* facing downwardly toward the wall 136, so that the edge portion is concealed from finger or thumb contact.

The intermediate portion 150 may be provided with a portion 152 extending upwardly from the first and second end portions 148 and 146, and having an arcuate shape which matches the confronting shape of the edge 157 of the opening 156, when the openable member 137 is fully opened as described below.

Considering the operation of the embodiment shown in FIGS. 16–19, opening is initiated by pressing downwardly on the lip 151 of the opening tab member 139. The downward force on the lip 151 is applied to the underlying portion of the separable region 138 to fracture the fracturable web 145, so that the openable member 137 becomes completely detached from the wall 136. The openable member 137 remains secured to the wall by attachment with the opening tab member 139, however, and the aforementioned greater dimensions of the openable member relative to the opening 156 prevent the openable member from being withdrawn outwardly through the opening.

Opening is completed by simply pressing the lip 151 of the opening tab member 139 in a direction parallel to the wall 136, so that the opening tab member pivots about the rivet 141 to assume the fully-open position shown in FIG. 18. The openable member 137 and the first end portion 148 of the opening tab member are slidably displaced beneath the wall 136, and the arcuate shape of the surface 152 permits all but the lip 151 of the opening tab member to be pivoted away from the opening 156.

It will be seen from the foregoing description of disclosed embodiments that the easy-open container of the present invention is readily openable while remaining attached to the container at all times.

It will be understood that the foregoing relates only to preferred embodiments of the present invention, and that changes and modifications may be made therein without departing from the spirit and the scope of the invention as set forth in the following claims.

We claim:

1. An easy opening container, comprising:

a container wall having an outer surface and an inner surface;

an openable member defined in said wall by a selectably separable region;

an opening tab member secured to the outer surface of said openable member and having means which overlies at least a portion of said separable region;

said opening tab member having means to transmit force to said wall in the vicinity of said separable region to fracture said separable region when force is applied to said opening tab member in a direction toward said wall; and said overlying means being configured to allow said openable member to move a predetermined limited distance inwardly from said wall when said separable region becomes separated, and being movable with said opening tab member along said outer surface of said wall to displace said openable member along said inner surface of said wall.

2. A container as in claim 1, wherein:

said overlying means comprises a first portion of said opening tab member;

said opening tab member includes a second portion connected to said first portion and extending a distance inwardly from said portion into securement with said openable member, so that first portion is maintained in spaced apart relation outwardly from said outer surface of said wall while said separable region remains intact, and so that said first portion can move inwardly to contact said outer surface and prevent free entry of said openable member into said container when said separable region becomes separated; and said second portion being slidably displaceable along said outer surface to carry said openable member along said inner surface.

3. A container as in claim 2, wherein said second portion of said opening tab member has a proximal portion which is secured to said openable member and which extends along said openable member to a distal portion, said distal portion being connected to said first portion of said opening tab member and overlying said outer surface of said wall beyond said openable member.

4. Apparatus as in claim 3, wherein said second portion of said opening tab member is receivable within the opening provided in said wall by said openable member upon fracture of said separable region, thereby allowing said first portion of said opening tab member to be moved generally parallel to said outer surface of said wall while said second portion enters said opening and displaces said openable member away from said opening.

5. Apparatus as in claim 4, wherein:

said openable member is defined by said separable region which is a closed such region on said wall, so that said openable member becomes completely separated from the remainder of said wall when said separable region is fractured; and means operatively associated with said openable member to prevent said separated openable member from being detached from said wall.

6. Apparatus as in claim 5, wherein said detachment preventing means is provided by a portion of said separated openable member which underlies a peripheral portion of said wall surrounding said opening.

7. Apparatus as in claim 5, wherein said detachment preventing means comprises means nondetachably connecting said opening tab member to said wall.

8. Apparatus as in claim 4, wherein said openable member is defined by said separable region which is interrupted on said wall by a nonseparable region, said nonseparable region providing a bend line about which said openable member pivots beneath said inner surface of said wall in response to movement of said opening tab member along said outer surface.

9. Apparatus as in claim 1, further comprising:

means on said openable member to engage a peripheral portion of said wall surrounding said opening provided by fracture of said separable region, so that said engaging means prevents said separated openable member from being withdrawn through said opening.

10. A container as in claim 1, wherein:

said separable region which defines said openable member is interrupted by nonfracturable means defining a hinge means about which said openable member can move after fracture of said separable region; and said opening tab member includes means extending from said overlying means to said openable member to move said separated openable member about said hinge means and displace said separated openable member beneath said inner surface and into the container in response to sliding movement of said opening tab member along said outer surface of said wall.

11. A container as in claim 11, wherein said separable region which defines said openable member is uninterrupted so that said openable member becomes completely separated from said wall and is thereafter retained with said wall by said opening tab member.

12. The container as in claim 1, wherein:

said opening tab member is secured to said openable member by securement means which is located within said separable region and which becomes disposed beneath said inner surface of said wall when said overlying means of said openable member is moved along said outer surface.

13. An easy opening container comprising:

a container wall;

an openable member defined in said wall by a selectably separable region, so that an opening is formed in said wall by fracture of said separable region;

means for concentrating an opening force at said separable region for fracturing the separable region; and means for mounting said openable member for rotation relative to said wall about a defined axis through and substantially perpendicular to said wall outside of said opening, so that said openable member is movable to expose said opening after said separable region is fractured.

14. The container as in claim 13 wherein:

said means for mounting said openable member comprises a member which is attached to said openable member and which extends across said separable region for rotatable attachment to said wall at the location of said axis.

15. The container as in claim 13 wherein:

said means for mounting said openable member comprises an opening tab member which is rotatably attached to said container wall for rotation about said axis;

said opening tab member bridging said separable region and being attached to said openable member;

said opening tab member having first means facing outwardly from said wall to receive manually applied force directed toward said wall; and said force concentrating means being provided by second means on said opening tab member facing inwardly toward said wall in the vicinity of said separable region.

16. The container as in claim 13 wherein:

said openable member is concave inwardly relative to said separable region;

said means for mounting said openable member comprises an opening tab member which is attached to said wall for pivotable movement about said axis;

said opening tab member extending across said separable region and having a position which is secured to said convex opening tab; and said portion of said opening tab being offset downwardly to fit within said concave openable member so that said openable member and said portion are readily movable below the periphery of said exposed opening after fracture of said separable region.

17. An easy opening container, comprising:

a container wall having an outer surface and an inner surface;

an openable member defined in said wall by a selectably separable region;

an opening tab member secured to the outer surface of said openable member and having means which overlies at least a portion of said separable region;

said opening tab member having means to transmit force to said separable region to fracture said separable region when force is applied to said opening tab member in a direction toward said wall;

said opening tab member extending from said securement with said openable member to a pivotal attachment with said wall outside of said openable member, so that said openable member upon fracture of said separable region is displaceable beneath said inner surface of said wall by rotating said opening tab member about said pivotal attachment; and said overlying means being configured to allow said openable member to move a predetermined limited distance inwardly from said wall when said separable region becomes separated, and being movable along said outer surface of said wall to displace said openable member along said inner surface of said wall.

18. The container as in claim 1, further comprising:

selectably separable vent means formed in said wall in spaced apart relation to said openable member, so that said opening tab member when displaced along said wall becomes positioned above said vent means; and wherein said opening tab member includes means which engages and opens said vent means when said displaced opening tab member is pressed toward said wall.

19. The container as in claim 1, wherein:

said opening tab member has a finger member which is joined to said overlying means and which extends apart from said overlying means to said securement to said openable member, so that said finger member slides beheath said container wall with said separated openable member as said opening tab member is displaced along said wall; and means disposed at the juncture of said finger member and said overlying means to engage the periphery of the opening which remains in said wall upon separation and displacement of said openable member.

20. The container as in claim 1, further comprising:

retaining means on said container wall in spaced apart relation to said openable member to retain said displaced openable tab member;

said retaining means having an inclined portion along which a part of said opening tab member can freely pass while being displaced along said wall, and having a retaining surface which said opening tab member engages after passing along said inclined portion, so as to inhibit return of said opening tab member to the undisplaced position.

21. An easy open container comprising:

a wall having an outer surface and an inner surface;

an openable member defined in said wall by a fracturable web at the root of a closed score line in the wall;

an opening tab member attached to the outer surface of said openable member; and means on said opening tab member to apply force directed toward said outer surface of said wall at a location in the vicinity of said fracturable web in response to force manually applied to said opening tab member in a direction toward said wall.

22. An easy opening container comprising:

a wall having an outer surface and an inner surface;

an openable member defined in said wall by a fracturable web along a closed separable region of predetermined weakness;

deflectable means formed in said wall adjacent said fracturable web and in surrounding relation therewith to undergo deflection relative to said openable member, in response to force directed toward said outer surface of said wall in the area of said separable region;

an opening tab member attached to the outer surface of said openable member; and means on said opening tab member to apply force directed toward said outer surface of said wall in the vicinity of said deflectable means in response to force manually applied to said opening tab member in a direction toward said wall.

23. An easy opening container comprising:

a wall having an outer surface and an inner surface;

an inwardly concave openable member defined in said wall by a fracturable web at the root of a closed score line in said wall;

an opening tab member attached to said openable member at a location on said concave outer surface thereof;

said opening tab member having flange means extending to cover said outer surface of said wall along at least part of said fracturable web; and means on said flange means to said opening tab member to apply force directed toward said outer surface in the vicinity of said fracturable web in response to force manually applied to said opening tab member in a direction toward said wall.

24. An easy opening container comprising:

a wall having an outer surface and an inner surface;

an openable member defined in said wall by a fracturable web at the root of a closed score line in said outer surface of said wall;

the outer surface of said openable member being concave inwardly relative to said score line;

deflectable means formed in said wall adjacent said fracturable web and in surrounding relation therewith to undergo deflection relative to said concave openable member, in response to force directed toward said outer surface of said wall in the vicinity of said deflectable means;

an opening tab member attached to said concave openable member at a location on the outer surface thereof which is beneath the plane of said fracturable web;

said opening tab member having means extending across said score line and overlying a portion of said wall outer surface in surrounding relation to said score line; and means on said opening tab member to apply force directed toward said outer surface of said wall in the vicinity of said deflectable means in response to the manual application of force to said opening tab member in a direction toward said wall, so that said web becomes fractured by said deflection whereupon said openable tab member and said attached openable member move inwardly a distance from said wall and are there retained for displacement along said inner surface of said wall by contact between said wall outer surface and said means on said opening tab member extending thereacross.

* * * * *